US011952867B2

(12) United States Patent
Haggart

(10) Patent No.: US 11,952,867 B2
(45) Date of Patent: Apr. 9, 2024

(54) OVERHEAD ROTATING SAFETY TETHER RING

(71) Applicant: ProTorque Connection Technologies Ltd., Edmonton (CA)

(72) Inventor: Steven Haggart, Spruceview (CA)

(73) Assignee: Protorque Connection Technologies, Ltd., Edmonton (CA)

( * ) Notice: Subject to any disclaimer, the term of this patent is extended or adjusted under 35 U.S.C. 154(b) by 0 days.

(21) Appl. No.: 17/693,932

(22) Filed: Mar. 14, 2022

(65) Prior Publication Data

US 2022/0298890 A1 Sep. 22, 2022

Related U.S. Application Data

(60) Provisional application No. 63/162,837, filed on Mar. 18, 2021.

(51) Int. Cl.
*E21B 19/10* (2006.01)
*E21B 40/00* (2006.01)

(52) U.S. Cl.
CPC ..... *E21B 40/00* (2013.01)

(58) Field of Classification Search
CPC ..... E21B 19/06; E21B 19/07; E21B 19/10; E21B 19/16; E21B 3/022; E21B 40/00
See application file for complete search history.

(56) References Cited

U.S. PATENT DOCUMENTS

| | | | | |
|---|---|---|---|---|
| 1,397,072 | A * | 11/1921 | Black | E21B 19/06 294/90 |
| 3,342,520 | A * | 9/1967 | Haynes | E21B 19/07 294/90 |
| 7,909,120 | B2 | 3/2011 | Slack | |
| 10,648,250 | B2 * | 5/2020 | Peveri | E21B 19/155 |
| 10,718,197 | B2 * | 7/2020 | Roodenburg | E21B 3/022 |
| 2011/0174542 | A1 * | 7/2011 | Sinclair | E21B 17/00 175/57 |
| 2012/0048533 | A1 * | 3/2012 | Barker | E21B 17/00 166/77.51 |
| 2014/0076583 | A1 * | 3/2014 | Robichaux | E21B 19/24 166/96.1 |
| 2015/0275592 | A1 * | 10/2015 | Wood | E21B 19/07 166/380 |
| 2016/0076324 | A1 | 3/2016 | Allen et al. | |

FOREIGN PATENT DOCUMENTS

WO WO2015/143544 10/2015

OTHER PUBLICATIONS

Volant—Tool Joint Lock, TJL2-6.25 Specification Summary.
Volant—Tether Swivel Accessory, TSA4 Specification Summary.
Revolution—CRT Tether, 19001-100 Speccification Summary.

* cited by examiner

*Primary Examiner* — Kipp C Wallace

(57) ABSTRACT

A fall arrest safety system for overhead rotating tools includes a tether ring assembly having an inner ring and an outer ring. The inner ring clamps onto the rotating tubular and the outer ring is tethered to the top drive unit. In the event of a disconnect, the tethered assembly holds the load.

6 Claims, 7 Drawing Sheets

Fig. 3
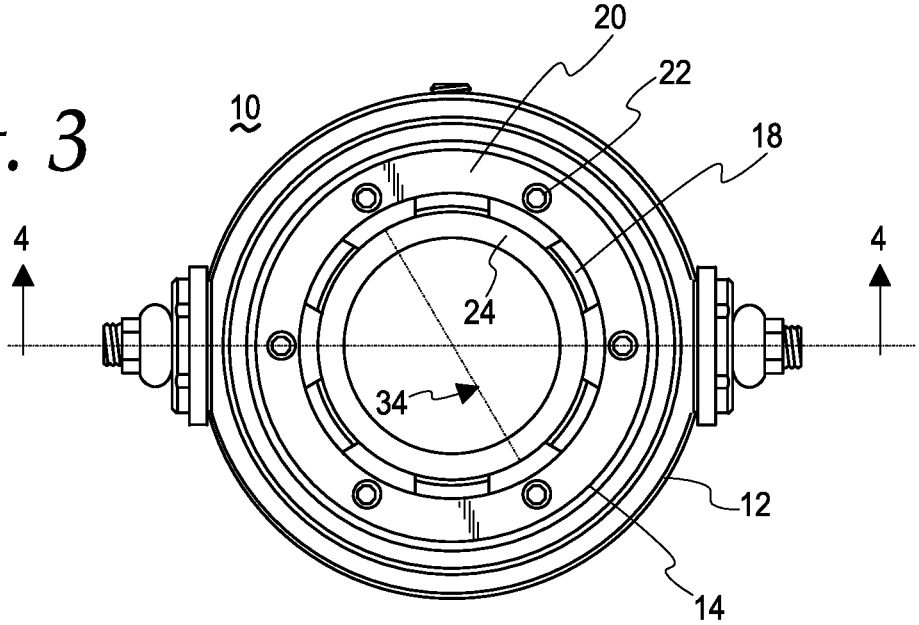
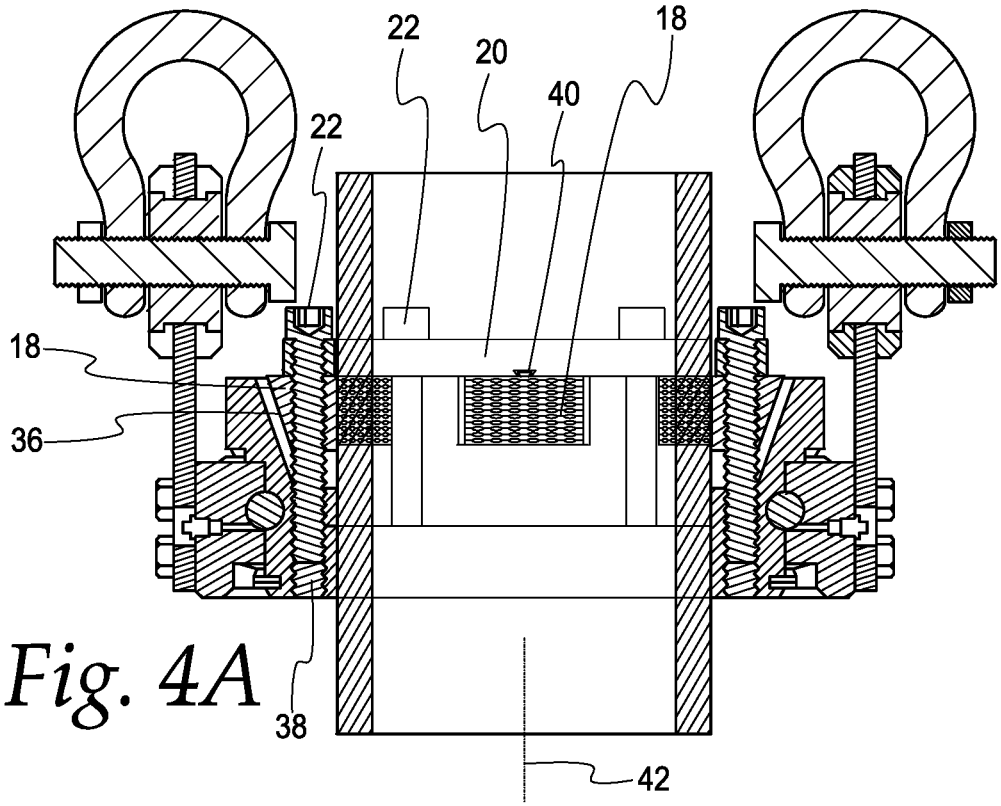
Fig. 4A

OVERHEAD ROTATING SAFETY TETHER RING

CROSS-REFERENCE TO RELATED APPLICATION

This application claims the benefit of U.S. Provisional Patent Application No. 63/162,837 filed Mar. 18, 2021, which is hereby incorporated by reference in its entirety herein.

BACKGROUND OF THE INVENTION

I. Field of the Invention

The present disclosure relates generally to tools for rig drilling equipment in the field of oil and gas wells, and more specifically to a safety apparatus and system for oilfield tubulars, and more particularly to an apparatus, method and system to hold the load of an overhead tool if the drive connection becomes inadvertently decoupled.

II. Description of the Prior Art

Conventional drilling operations for hydrocarbon exploration, exploitation and production utilize many lengths of individual tubulars which are made up into a string, where the tubulars are connected to one another by means of screw threaded couplings provided at each end. Various operations require strings of different tubulars, such as drill pipe, casing and production tubing.

The individual tubular sections are made up into the required string which is inserted into the ground by a make up/break out unit, where the next tubular to be included in the string is lifted into place just above the make up/break out unit. A first conventional method of doing this includes machining a ring on a sub and using a set of single joint elevators. A second conventional method of handling this includes bolting a non-bearing ring to the tool that allows a separate ring to clamp around it and rotate.

Once lifted into place, conventional drilling rigs utilize a make up/break out system to couple/decouple the tubular pipe sections from the tubular string. A conventional make up/break out system comprises a lower set of tongs, which are brought together to grip the lower pipe like a vice, and an upper set of tongs which firstly grip and then secondly rotate the upper pipe relative to the lower pipe and hence screw the two pipes together. In addition to this conventional make up/break out system, a conventional drilling rig utilizes a rotary unit to provide rotation to the drill string to facilitate drilling of the borehole, where the conventional rotary unit is either a rotary table provided on the drill rig floor or a top drive unit which is located within the drilling rig derrick.

Many tools exist that are for use on top-drive-equipped rigs to facilitate insertion of a casing string into the wellbore, as well as for other casing-related operations. One example of such a tool is the so-called Gripping Tool described in U.S. Pat. No. 7,909,120, which is incorporated by reference herein. Such tools are known in the industry as casing running tools (CRTs). Prior to use, a CRT must be rigidly attached to the top drive. A shouldering threaded connection, known as a tool joint, is the primary means of connection. This process is known as "rigging in" the tool. As with all threaded connections, a risk exists that the connection might be unintentionally disengaged. In the case of CRTs and other equipment attached to the top drive, unintentional disengagement of the connection can result in a significant safety hazard from falling objects.

A fall arrest system attached to the connected equipment can be a suitable means for reducing this safety hazard. Presently available fall arrest systems include joint locks and tether swivel accessories. A tool joint lock is installed over the tool joint connections to prevent unintentional connection back-off during drilling and casing running operations and to prevent incremental thread make-up during an over torqueing incident. An exemplar tether swivel accessory secures the CRT to the top drive via cables with in-line single use energy absorbers. This type of system acts as a means of fall arrest should the tool or crossover back off the quill. Disadvantages of the current systems include, for example, their dependency on size and/or weight of the top drive, their mounting directly to the tool and cost and/or time expense.

The present disclosure overcomes the disadvantages of presently available fall arrest systems. Accordingly, it is a general object of this disclosure to provide an improved tool fall arrest system.

It is another general object of the present disclosure to provide a fall arrest system that is easy to use and enhances rig safety.

It is still another general object of the present disclosure to provide a fall arrest system that is not dependent upon tool size or weight.

It is a more specific object of the present disclosure to provide a rotating safety tether ring.

Still a more specific object of the present disclosure is to provide a safety tether bearing ring.

It is still another more specific object of the present disclosure to provide a tether ring positioned between the rotary shoulder on the top drive and a tool.

These and other objects, features and advantages of this disclosure will be clearly understood through a consideration of the following detailed description.

SUMMARY OF THE INVENTION

According to an embodiment of the present disclosure, there is provided a fall arrest system for overhead tools including an assembly positioned between a rotary unit and a rotating tool whereby a first member is attached to the unit and a second member has a first position and a second position wherein the second position couples the second member to the tool. A bearing assembly between the members enables the second member to rotate with the tool when in the second position.

According to an embodiment of the present disclosure there is also provided a tool fall arrest device including a ring assembly positioned between a rotary unit and a rotating tool wherein the assembly having an outer ring and an inner ring. The outer ring is tethered to the rotary unit while the inner ring has an unengaged position and an engaged position wherein the engaged position clamps the inner ring to the rotating tool. A bearing assembly is positioned between the rings and enables the inner ring to rotate relative the outer ring.

According to an embodiment of the present disclosure there is also provided a method for positioning a safety system for overhead tools including positioning an assembly between a rotary unit and a rotating tool wherein the assembly has a bearing between a first and a second member, tethering the first member of the assembly to the rotary unit, and clamping the second member of the assembly to the rotating tool.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which:

FIG. 3 is a top plan view of the tether ring assembly of FIG. 2.

FIG. 4A is a cross-sectional view taken along lines 4-4 of the tether ring assembly of FIG. 3 with the ring assembly in the open position.

DESCRIPTION OF THE PREFERRED EMBODIMENTS

One or more embodiments of the subject disclosure will now be described with the aid of numerous drawings. Unless otherwise indicated, use of specific terms will be understood to include multiple versions and forms thereof.

Generally, the bearing ring device of the present disclosure is designed to hold the load of an overhead tool if the rotary unit connection becomes disconnected. While it has been designed to catch a load of approximately three thousand pounds at two feet, it will be appreciated that minor modifications would enable a larger load and a greater falling distance. In any event, the tether is secured to the top drive using a clevis/shackle and a cable sling/chain or any other suitable securement method dependent upon the applicable load. A bearing assembly within the ring allows for the attached assembly to freely rotate as the CRT or drill pipe rotates. Specifically, the ring attaches to the outer diameter (OD) of the tool using an adjustable clamping system. The preferred embodiment can accommodate a tubular OD range of approximately one inch, but it will be appreciated that it can be scaled to any size and range of tool OD. As such, the present disclosure provides for a rotating safety tether ring positioned between the rotary unit on the top drive and a tool, such as a CRT. Essentially, the subject device bites, using a wedge and teeth, onto the OD of a tubular (e.g. CRT) and is then secured (or tethered) to the top drive.

Figure 1:
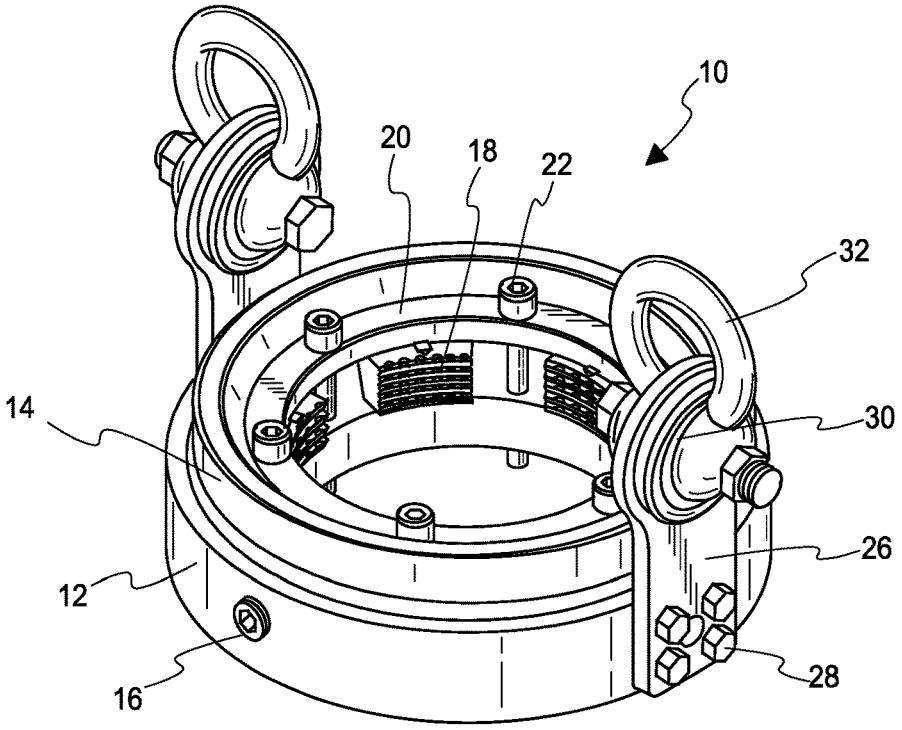
FIG. 1 is a top right perspective view of a tether ring assembly according to the principles of an embodiment of the present disclosure.

Turning now to the Figures to better illustrate the device, and in particular FIG. 1, a rotating safety tether assembly ring 10 is shown in a perspective view. This assembly includes a first member comprising an outer ring 12 and a second member comprising an inner ring 14. The outer ring 12 including a grease port 16 to enable the lubrication of the bearings positioned within and between the outer ring 12 and the inner ring 14. These bearings allow the rings to rotate relative one another. More specifically, the inner ring 14 rotates when it is engaged with a rotating tubular via the clamps or dies 18 clamping the tubular OD by tightening the clamping member ring 20 down with the clamp ring bolts 22.

Figure 2:
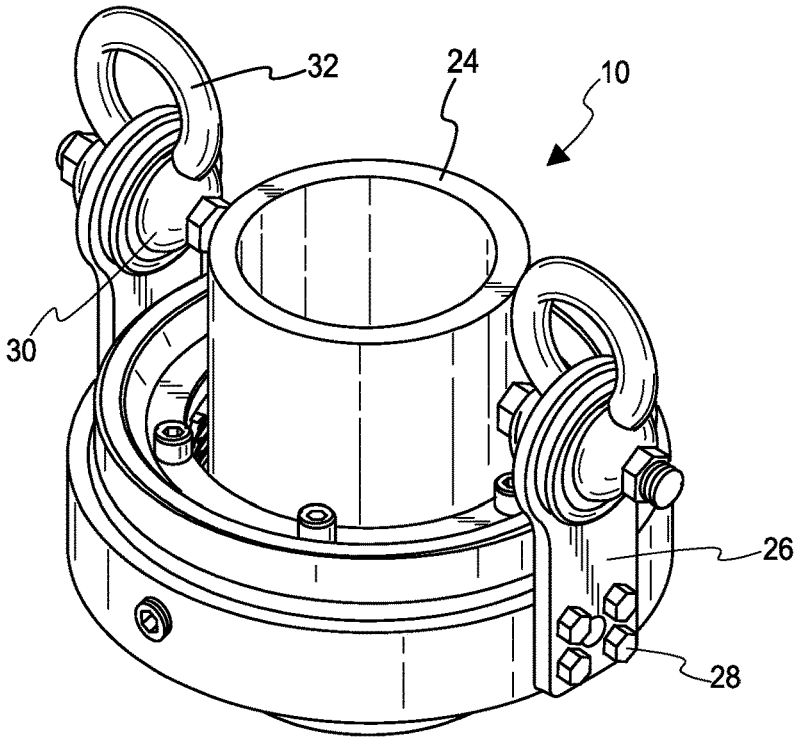
FIG. 2 is a top right perspective view of the tether ring assembly of FIG. 1 with an engaged tubular.

FIG. 2 illustrates the safety tether ring 10 engaged with a tubular 24, such as a CRT. The safety tether ring 10 includes anchors 26 fastened to the outer ring 12 via bolts 28 or the like. These anchors 26 support the shock absorbers 30 and U-bolts/circle bolts 32 which are tethered to the top drive or other support member. It is the tethers that will catch the disconnected tubular in the event of a disconnect.

The safety tether ring 10 of FIG. 2 is shown from the top in FIG. 3. This view better illustrates the dies 18 clamped against the OD 34 of the tubular 24. This view also may better illustrate the outer ring 12 and the inner ring 14, and more specifically the relationship therebetween, whereby the inner ring 14 is rotatable relative the outer ring 12 when the clamping bolts 22 tighten the clamping ring 20 down upon the dies and against the OD of the tubular 24.

Figure 4B:
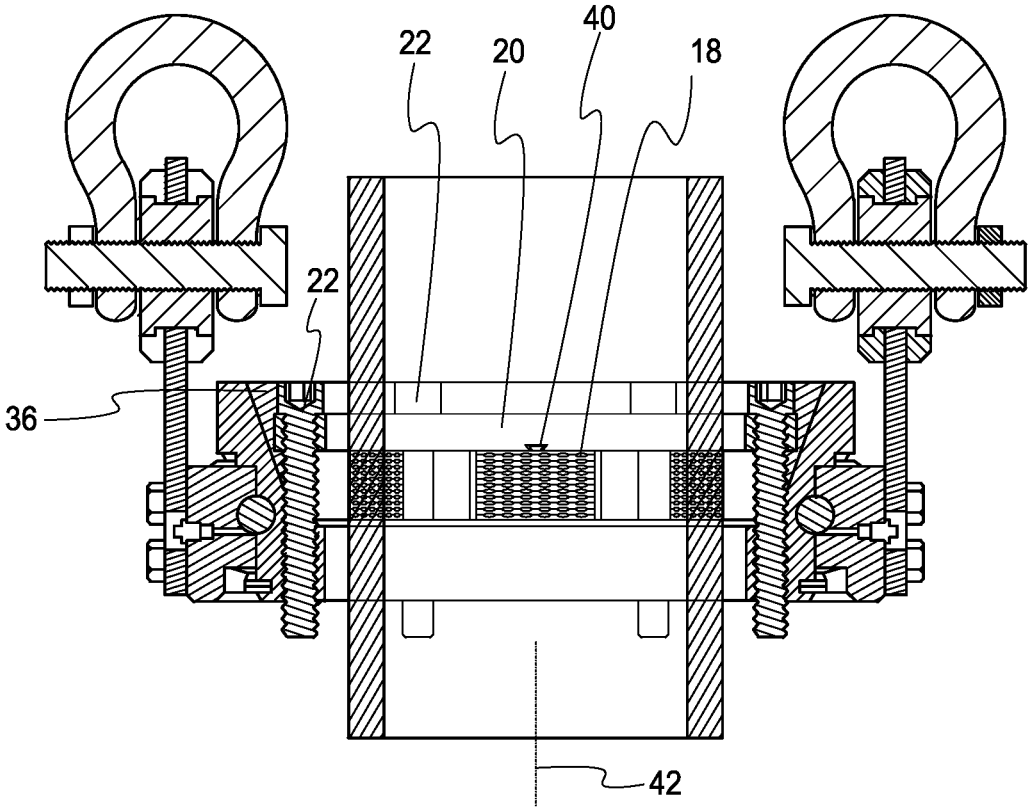
FIG. 4B is a cross-sectional view taken along lines 4-4 of the tether ring assembly of FIG. 3 with the ring assembly in the closed position.

The cross-sectional views of FIGS. 4A and 4B will illustrate an open or retracted position whereby the OD of the tubular is not engaged by the dies and a closed or extracted position whereby the OD of the tubular is engaged and locked by the dies, respectively. Referring first in FIG. 4A, the dies/inserts 18 are near the top of the sloped inner rim or ring ramp 36 and the die ring bolts 22 are not completely threaded through the bolt threads 38. When the bolts 22 are tightened against the clamping ring 20, referring now to FIG. 4B, the bolts 22 traverse the threads 38 and the ring pushes the dies 18 down the ramp 36 via the guides (supra) traversing the clamping ring guide channels 40 from the outside of the clamping ring towards the center 42 of the tubular. As such, the dies 18 bite into the OD of the tubular.

Figure 5:
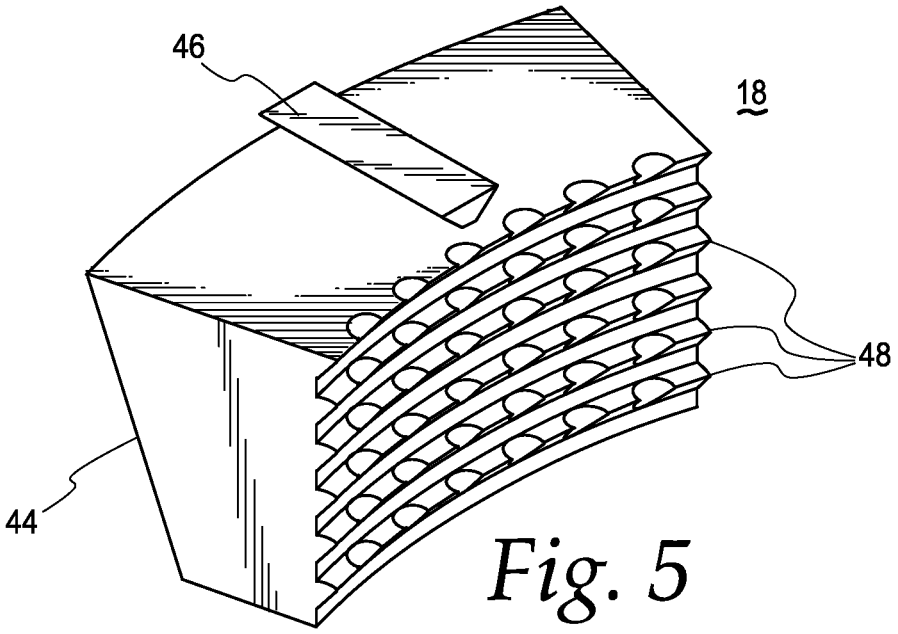
FIG. 5 is a perspective view of the die/insert of the tether ring assembly of FIG. 1.

The enlarged view of the die 18 of FIG. 5 illustrates the ramp-wedge backing 44 which rides the inner ring ramp 36, and the insert guide 46 which traverses the channel 40 or die alignment groove of the inner ring from the outside of the ring towards the center 42. The guides or keepers 46 keep the dies moving straight in and out as well as keeping the dies secured at all times. More specifically, the inserts 18 are forced downward using the clamp and wedge design. The back 44 of the die engages the tapered rim 36 of the inner ring and the front have teeth 48 to engage the OD of the tubular. This forces the guide along the groove and towards the center of the tubular and the die teeth 48 bite (penetrate) into the OD of the tubular and clamp/lock the inner ring to the tubular. The load of the tubular then applies more force and the dies bites harder into the tubular. Indeed, if the tool is dropped the wedge design will bite the dies harder to secure the overhead load.

Figure 6:
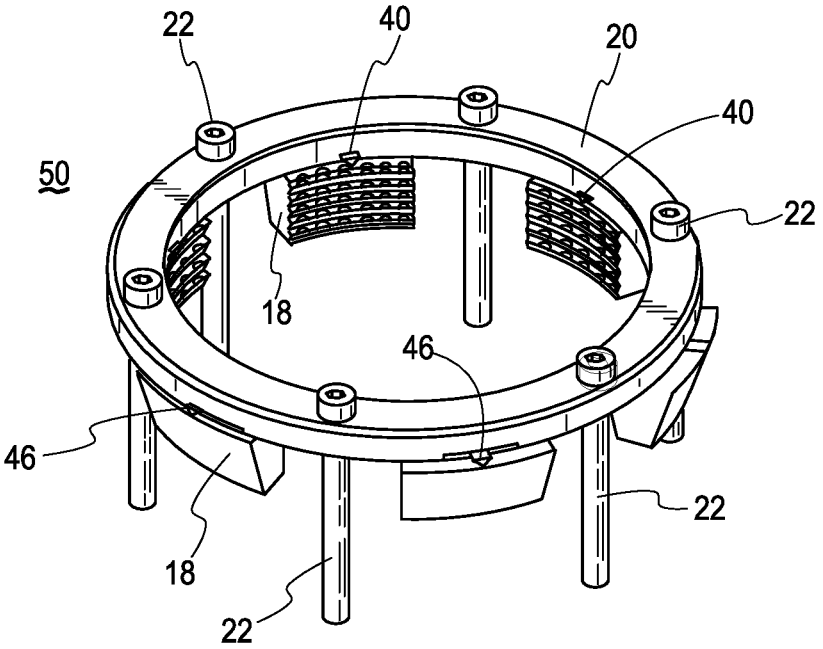
FIG. 6 is a perspective view of the die engagement assembly of the tether ring assembly of FIG. 1 in the retracted position.
Figure 7:
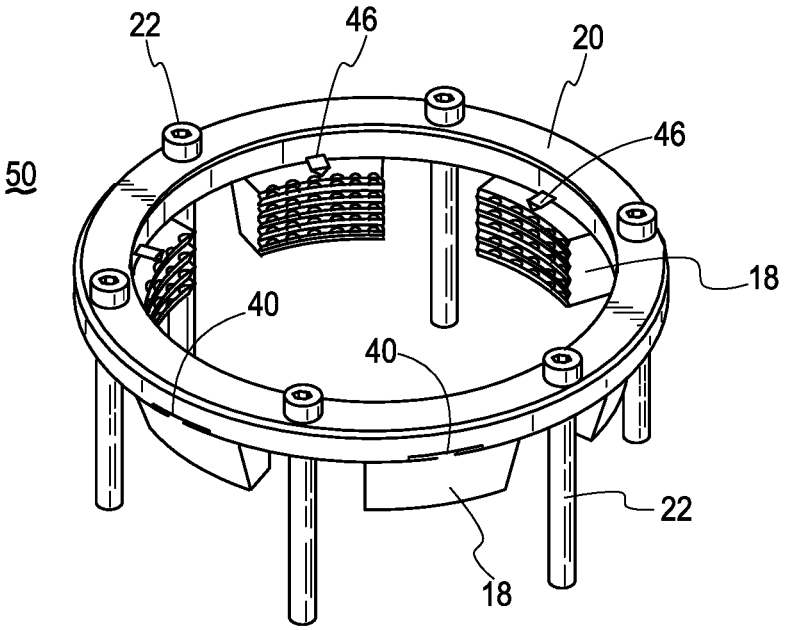
FIG. 7 is a perspective view of a die engagement assembly of the tether ring assembly of FIG. 1 in the activated position.

The die/insert engagement assembly 50 is illustrated in the isolated perspective views of FIGS. 6-7. This assembly 50 includes the clamping or activation ring 20, die ring bolts 22, and the clamping dies or inserts 18. FIG. 6 shows the assembly 50 in an open position whereby the dies 18 are positioned away from the center and FIG. 7 shows the assembly 50 in a closed position whereby the dies 18 are positioned closer to the center. In particular, the die guides 46 of the dies 18 traverse the clamping ring channels 40 from the outside to the inside and the ring is tightened down from FIG. 6 to FIG. 7. Essentially, as activation ring is driven downward, the dies are forced downward, the dies are forced down the inner ring ramp and inward to engage the teeth of the dies on the OD of the tubular.

Figure 8:
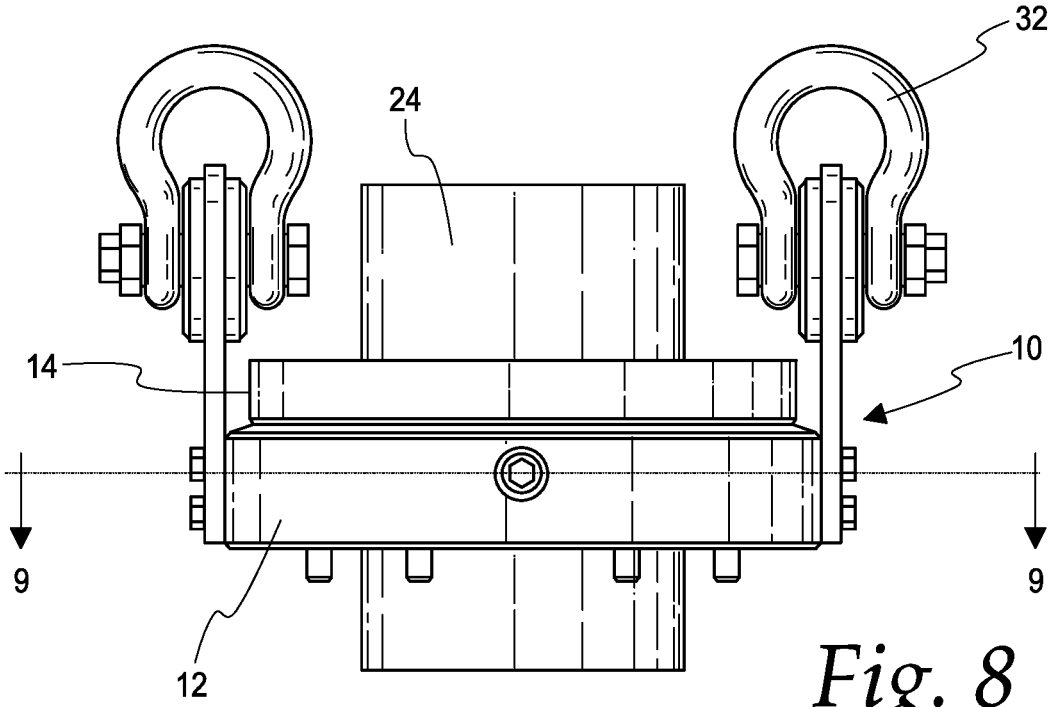
FIG. 8 is a frontal view of the tether assembly of FIG. 1.
Figure 9:
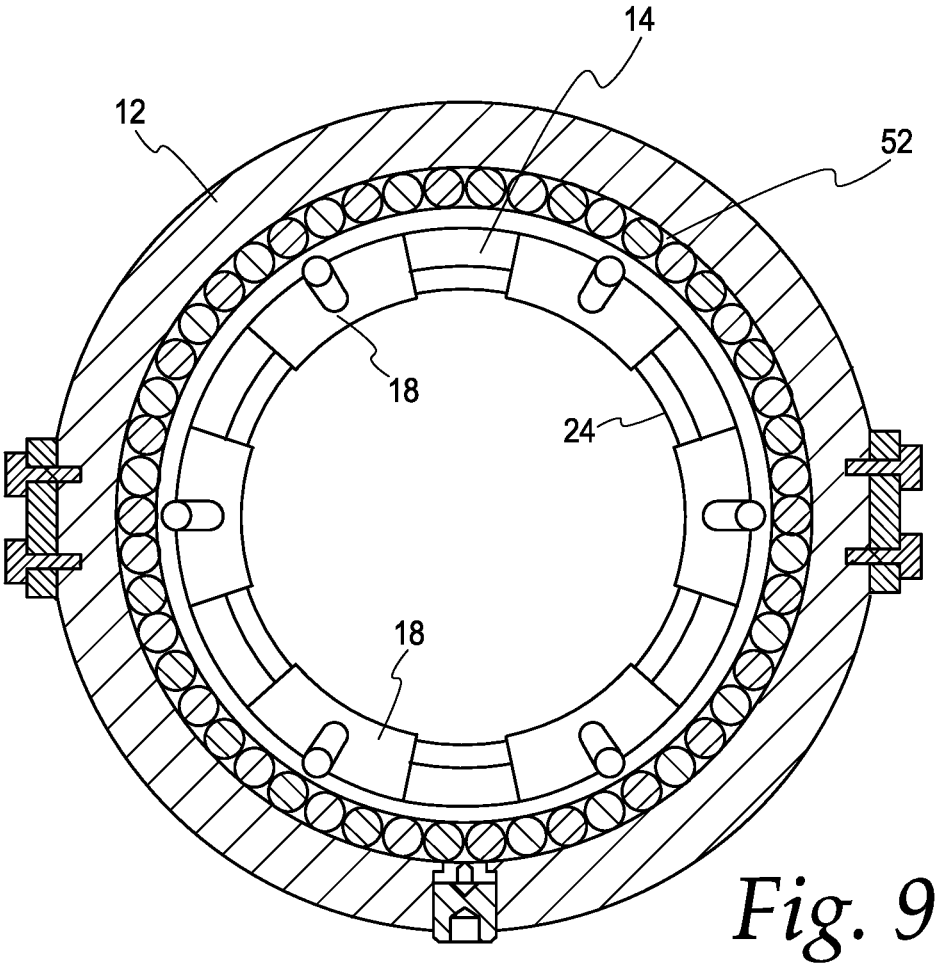
FIG. 9 is a cross-sectional view taken along lines 10-10 of the tether ring assembly of FIG. 8.

The rotational feature of the present disclosure will now be more specifically described. As previously noted, the rotating safety tether assembly ring includes an outer ring, which remains relatively stationary, and an inner ring, which clamps down on the rotating tubular and rotates therewith. This is accomplished via a bearing assembly working between the outer ring and the inner ring. Turning to FIGS. 8 and 9, the rotating safety tether ring 10 is clamped onto a tubular 24. Again, the bearing assembly 52 allows the tubular to freely rotate during normal operation, while maintaining securement. More specifically the activation ring, dies 18 and inner ring 14 will be attached to the tubular 24, while the outer ring 12 stays relatively stationary when the load securement ears or U-bolts 32 are attached to the rig or top drive via an appropriately rated sling, tether or another securement device.

Figure 10:
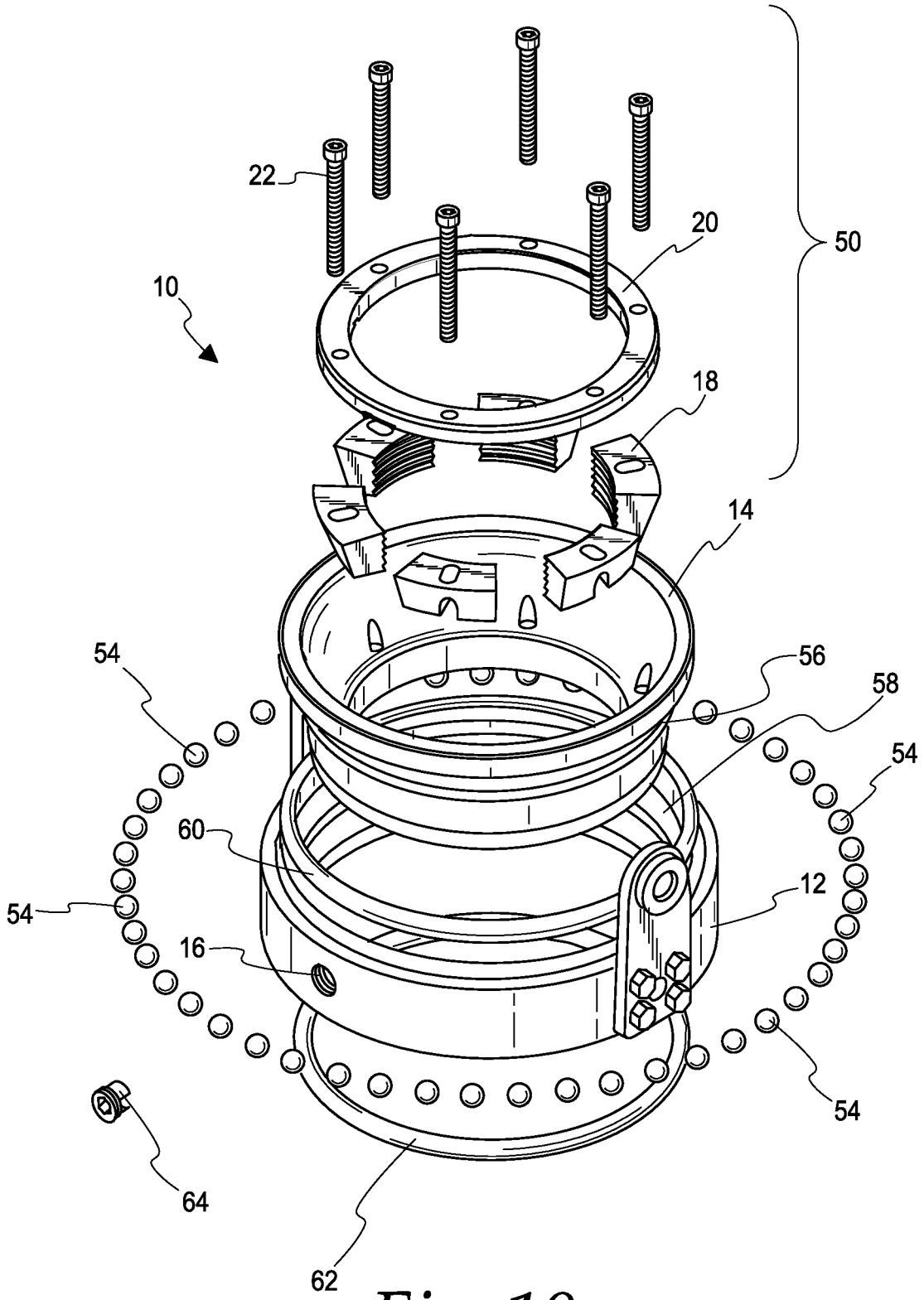
FIG. 10 is an exploded view of the tether ring assembly of FIG. 1.

FIG. 10 is an exploded view of the rotating safety tether ring 10 of FIG. 1. The component parts thereof are illustrated therein. The die engagement assembly 50 includes the clamping ring 20, the dies or inserts 18 and the clamp ring bolts 22. The bearing assembly 52 includes bearings 54 that are positioned within and between the inner ring bearing channel 56 and the cooperating outer ring bearing channel 58. This bearing assembly is lubricated through the grease port 16 and the grease is contained via inner gasket 60, outer gasket 62 and the bearing insert plug 64.

Figure 11:
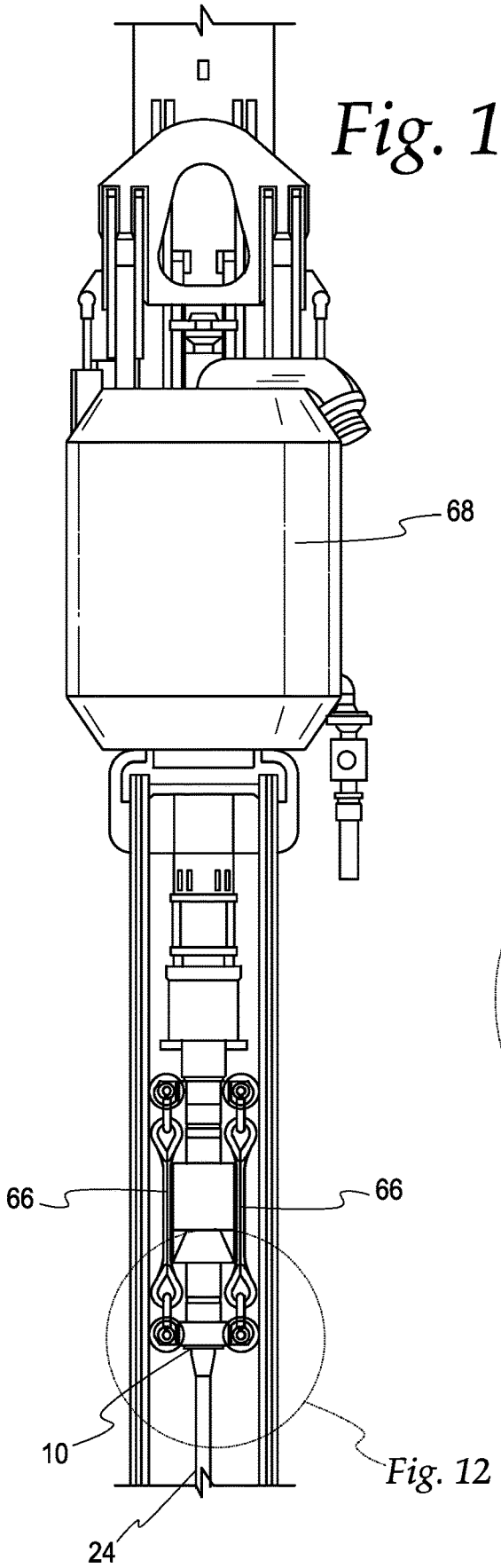
FIG. 11 is a side view of the tether ring assembly according to the principles of an embodiment of the present disclosure coupled to a tubular and tethered to a top drive unit.
Figure 12:
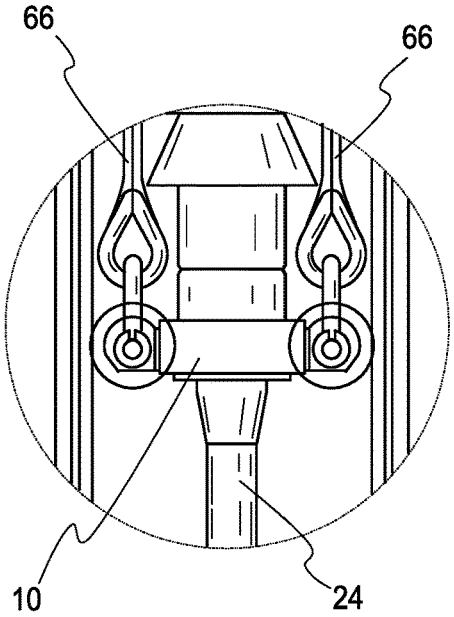
FIG. 12 is an enlarged view of the circle 12 of the tether ring assembly of FIG. 11.

As shown in FIGS. 11 and 12, shackles and overhead rated safety slings 66 are used to secure the tubular 24 to the top drive 68. In the event that the top drive 68 does not have a suitable securement point, a second tether ring can be installed onto the top drive quill or saver sub above the grabber box assembly. In any event, the rotating tether safety ring 10 assembly allows the tubular 24 to rotate, uninhibited, while it is in operation and still maintain overhead securement. Once secure, the top drive and the tubular can be used as per normal parameters. If, at any time, the tubular backs out of the quill/saver sub (connection to the top drive) it will fall and be caught by the rotating tether safety ring 10 assembly.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention if its broader aspects, and, therefore, the aim in the appended claims is to cover all such changes and modifications as fall within the true spirit and scope of the present disclosure.

What is claimed is:

1. A fall arrest system for securing overhead tools while in use, said system comprising:

a main assembly positioned between a rotary unit and a fully made-up connected rotating tool string, said tool string having a longitudinal axis, said assembly including a first member and a second member;

said first member having a first state during connected tool string operation and a second state coupled to said rotary unit;

said second member includes a clamping ring assembly having including a clamping ring, at least one insert having an insert guide attached thereto whereby said insert guide traverses a channel on said clamping ring along an axis which is substantially perpendicular to the longitudinal axis which brings said insert into engagement with said tool string when said assembly is clamped from a first position to a second position whereby said second position couples said second member to said tool string;

a bearing assembly positioned between said members whereby said second member rotates with said tool string when said second member is in said second position; and at least one anchor for coupling said first member to said rotary unit and holding said tool string in the event of a rotary unit disconnect.

2. The system as defined by claim 1 wherein said anchor includes a shock absorber.

3. The system as defined in claim 1 wherein said insert includes a back wedged portion for engaging said rim and a front teeth portion for engaging said tool.

4. A tool fall arrest device for securing an overhead tool while in use, said device comprising:

a ring assembly positioned between a rotary unit and a fully made-up connected rotating tool string, said tool string having a longitudinal axis, said assembly including an outer ring and an inner ring;

said outer ring having a first state during connected tool string operation and a second state tethered to said rotary unit;

said inner ring includes a clamping ring assembly including a clamping ring, at least one insert having an insert guide attached thereto whereby said insert guide traverses a channel on said clamping ring along an axis which is substantially perpendicular to the longitudinal axis which brings said insert into engagement with said tool string when said assembly is clamped from an unengaged position and to an engaged position whereby said engaged position clamps said inner ring to said rotating tool string;

a bearing positioned between said rings whereby said inner ring rotates with said rotating tool string when said inner ring is clamped to said rotating tool string; and at least one anchor for coupling said outer ring to said rotary unit and holding said rotating tool string in the event of a rotary unit disconnect.

5. The device as defined by claim 4 wherein said anchor includes a shock absorber.

6. The device as defined in claim 4 wherein said insert includes a back wedged portion for engaging said rim and a front teeth portion for engaging said tool.

* * * * *